United States Patent [19]

Moniot

[11] 4,079,868

[45] Mar. 21, 1978

[54] CASTELLATED TUNDISH NOZZLE

[75] Inventor: Daniel E. Moniot, Glenshaw, Pa.

[73] Assignee: Dresser Industries, Inc., Dallas, Tex.

[21] Appl. No.: 737,294

[22] Filed: Nov. 1, 1976

[51] Int. Cl.[2] ..... B05B 1/02
[52] U.S. Cl. ..... 222/591; 239/590
[58] Field of Search ..... 239/589, 590, 590.5, 239/601; 222/590–607; 266/236

[56] References Cited

U.S. PATENT DOCUMENTS

| | | | |
|---|---|---|---|
| 1,921,240 | 8/1933 | Porter | 222/607 |
| 3,486,700 | 12/1969 | Bristow | 239/590.5 |

*Primary Examiner*—Robert R. Song
*Assistant Examiner*—Michael Mar
*Attorney, Agent, or Firm*—R. T. Majesko; J. N. Hazelwood

[57] ABSTRACT

A tundish nozzle for use in the continuous casting of steel which has a castellated opening to prevent swirling of molten steel when poured therethrough.

6 Claims, 2 Drawing Figures

CASTELLATED TUNDISH NOZZLE

The commercial use of processes for the continous casting of steel seems destined to take an increasingly important position in contemporary steelmaking. Its many advantages in terms of cost, labor and simplicity of practice make it very attractive to a highly automated industry.

Continuous casting is generally defined as the making of a casting many times the length of the mold in which it is produced. Molten steel is poured into an open bottom mold of the desired product shape. The steel is cooled in the mold just enough to harden the exterior surface of the casting which forms a shell or container to hold the balance of the liquid metal. The partially solidified casting is then continuously withdrawn from the bottom of the mold where it is further cooled by water sprays until all the metal is solidified.

Preparing liquid metal for pouring and handling hot bars presents serious problems. The secret of success and wherein the problems arise is in handling the metal from the time it is poured from the ladle until it leaves the mold.

The tundish plays an important role in this process. The purpose of the tundish ladle is to maintain a uniform ferrostatic head. The nozzle opens from a lower portion of the tundish. This nozzle, which is so critical and important to controlling flow rate and stream cross section to the cooling stage mold. It must be characterized by resistance to skulling. "Skulling" can be defined as localized build-up of solidified metal and slag on interior surfaces of the nozzle and about its exit orifice.

The bath motion inside the ladle disturbes the pouring flow. This flow is also disturbed during pouring because the stream of molten steel swirls.

Accordingly, it is among the objects of the present invention to prevent the molten steel nozzle stream from swirling.

Figure 1:
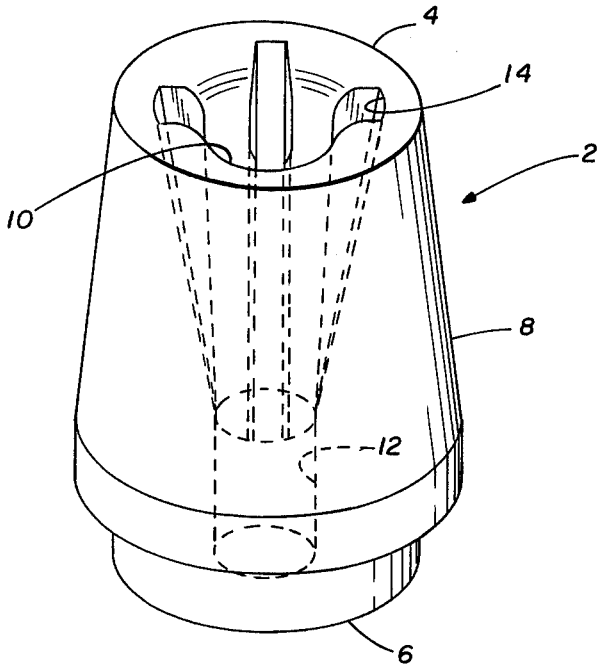
Figure 2:
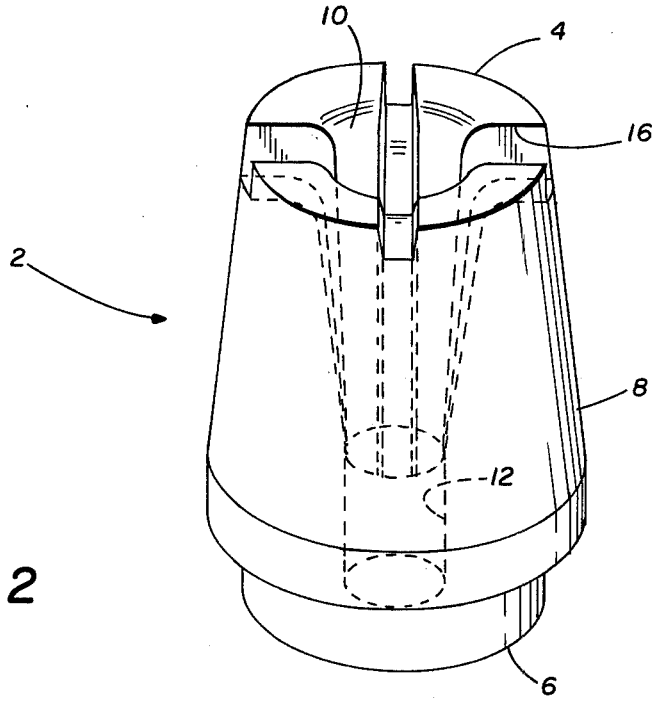

In order to more fully understand the nature and scope of the present invention, reference should be had to the following detailed description and drawings, in which:

FIG. 1 is a perspective view of a tundish nozzle construction according to one embodiment of the present invention; and FIG. 2 is a perspective view of a tundish nozzle according to another embodiment of the invention.

Briefly, in accordance with the present invention, there is provided a castellated nozzle, suitable for use in tundish ladles. The nozzle is in the form of a cylindrical shell of refractory material defining a nozzle opening. The shell contains an upper and a lower end. The nozzle opening contains a plurality of vertical grooves extending from the upper end to a distance short of the lower end.

Referring to the drawings, a ladle of steel is placed above a tundish in such a position to continuously discharge a stream of molten metal to the tundish and at such a rate as to maintain a substantially even bath depth in the tundish. A nozzle 2 according to this invention, opens from the bottom of the tundish and is so positioned that its bottom orifice discharges a stream of substantially constant volume and cross sectional dimension into the mold cavity wherein a shaping and skin formation is caused to form the steel strip.

The nozzle 2 consists of a cylindrical shell 8 of refractory material. The shell has an upper end 4 and a lower end 6.

The nozzle contains an opening 10 having a generally circular cross section. The nozzle opening tapers outwardly upwardly from a distance approximately two-thirds of the dimension between the upper end 4 and the lower end 6 to the upper end of the nozzle.

The nozzle opening 12 below the tapered opening is substantially uniform in cross section. The nozzle contains four grooves 14 spaced approximately 90° apart. The depth of the grooves decreases from the upper end to the nozzle opening portion 12. In FIG. 2, it is shown that the grooves may also extend horizontally across the upper surface as indicated at 16.

Accordingly, a castellated tundish nozzle is provided having grooves inside the nozzle opening but tapering to the required smooth opening for smooth stream exit from the nozzle.

The dimensions for the tundish and nozzle vary, depending upon the installation in which they are used. The shape of the nozzle is also variable depending upon the desire of the user. It can be generally inverted bell shaped with an orifice opening through the small end of the bell. It can be a truncated cone shape with the exit orifice formed through the smaller end of the cone.

It is intended that the foregoing description and drawings be construed as illustrative and not in limitation of the invention.

The embodiments of the invention in which an exclusive property or privilege is claimed are defined as follows:

1. A castellated nozzle, suitable for use in tundish ladles, consisting essentially of a cylindrical shell of refractory material defining a nozzle opening having a central passageway with an upper end defining an inlet and a lower end defining an outlet, which passageway tapers outwardly upwardly from a distance short of the lower end to the upper end, said passageway having a plurality of vertical grooves extending from the upper end to a distance short of the lower end, wherein the depth of the grooves decreases from the upper end to the lower end, each groove having a pair of substantially parallel walls at right angles to said central passageway.

2. A nozzle according to claim 1, in which the opening has a circular cross section.

3. A nozzle according to claim 2, in which there are four grooves spaced approximately 90° apart.

4. A nozzle according to claim 1, in which the grooves extend from the upper end to about two-thirds the distance to the lower end.

5. A nozzle according to claim 1, in which the grooves extend horizontally across the upper end.

6. A nozzle according to claim 1, in which the nozzle opening below said tapered opening is substantially uniform in cross section.

* * * * *